US009296528B2

(12) United States Patent
Fan et al.

(10) Patent No.: US 9,296,528 B2
(45) Date of Patent: Mar. 29, 2016

(54) CONTAINER WITH EASILY-DETACHED LID

(75) Inventors: Cheng-Kuei Fan, Taipei (TW); Yin-Kai Lee, Taipei (TW); Fu-Yu Cai, Taipei (TW); Shuo-Ren Syu, Taipei (TW)

(73) Assignee: National Taipei University of Technology, Taipei (TW)

( * ) Notice: Subject to any disclaimer, the term of this patent is extended or adjusted under 35 U.S.C. 154(b) by 0 days.

(21) Appl. No.: 13/612,992

(22) Filed: Sep. 13, 2012

(65) Prior Publication Data

US 2013/0134162 A1 May 30, 2013

(30) Foreign Application Priority Data

Nov. 24, 2011 (TW) ..... 100222254 U

(51) Int. Cl.
*B65D 39/16* (2006.01)
*B65D 43/02* (2006.01)

(52) U.S. Cl.
CPC ..... *B65D 43/022* (2013.01); *B65D 2543/0037* (2013.01); *B65D 2543/0049* (2013.01); *B65D 2543/0074* (2013.01); *B65D 2543/00546* (2013.01); *B65D 2543/00842* (2013.01)

(58) Field of Classification Search
CPC ..... B65D 2543/00842; B65D 2543/00851; B65D 2543/0037
USPC ..... 220/257.8, 258.2, 805, 793, 789, 791; 215/296, 295, 305; 229/125
See application file for complete search history.

(56) References Cited

U.S. PATENT DOCUMENTS

| | | | | | |
|---|---|---|---|---|---|
| 1,514,930 | A | * | 11/1924 | Reynolds | 220/309.2 |
| 1,596,367 | A | * | 8/1926 | Miller | 220/293 |
| 1,707,091 | A | * | 3/1929 | Perry | 229/5.5 |
| 1,711,749 | A | * | 5/1929 | Schmitt | 220/264 |
| 2,052,595 | A | * | 9/1936 | Baker | 220/258.3 |
| D142,712 | S | * | 10/1945 | Gilchrist | D7/360 |
| 3,163,311 | A | * | 12/1964 | Stolk | 426/106 |
| 3,443,720 | A | * | 5/1969 | Al-Roy | 220/791 |
| 2002/0190067 | A1 | * | 12/2002 | Getsy | 220/256.1 |
| 2007/0023433 | A1 | * | 2/2007 | Vahavihu | 220/254.7 |

* cited by examiner

*Primary Examiner* — Jeffrey Allen
(74) *Attorney, Agent, or Firm* — Alan D. Kamrath; Kamrath IP Lawfirm, P.A.

(57) ABSTRACT

A container has a main body and an easily-detached lid. The main body has an opening, and a main body engaging element is disposed around the edge of the opening. The lid has a lid engaging element corresponding to the main body engaging element for allowing the lid to engage with the main body via the main body engaging element and the lid engaging element. A wall is disposed at the outer boundary of the lid, and the wall has at least one tilting portion.

19 Claims, 5 Drawing Sheets

CONTAINER WITH EASILY-DETACHED LID

BACKGROUND OF THE INVENTION

1. Field of the Invention

The present invention relates to a container with an easily-detached lid. More particularly, the present invention relates to a container with an easily-detached lid detachable from a container main body without any tools, and the contents inside the container will not accumulate on an area where a finger touches of the lid.

2. Description of the Related Art

The quality of life of humans has been improved greatly as technology advances. For consumer-oriented products, it is important to apply a significant improvement in the structure of a product to enhance the quality and the security of the product.

Containers, such as paint cans or milk cans, of the prior art apply a rounded tenon structure set on the upper surface of the main body of the container to engage with a tenon structure set in the lid. This has been the design for many years. However, for releasing the engagement between the lid and the main body of the container, a tool is needed, and the lid may be contaminated by the contents inside the container. The need for a tool causes inconvenience to the user, and additional inconvenience is caused by the fact that the cleanness of the lid cannot be ensured.

Therefore, there is a need for a container with an easily-detached lid removed easily without tools, such that the cleanness of the container can be ensured to obviate the problems in the prior art.

SUMMARY OF THE INVENTION

An object of the present invention is to provide a container with an easily-detached lid removable without any tool.

Another object of the present invention is to provide a container with an easily-detached lid ensuring the cleanness of the lid, because the contents inside the container will not accumulate on an area where a finger touches of the lid when the lid is disengaged from the container of the present invention and placed separately.

To achieve the abovementioned objects, the container with an easily-detached lid of the present invention comprises a main body and a lid. The main body has an opening and a main body engaging element disposed around the edge of the opening. The lid has a lid engaging element corresponding to the main body engaging element for allowing the lid to engage with the main body via the main body engaging element and the lid engaging element. The lid engaging element is characterized in that a wall is disposed at an outer boundary of the lid and in that the wall comprises at least one tilting portion.

According to one embodiment of the present invention, the main body comprises an outer edge wall, and at least one recess is disposed thereon.

According to one embodiment of the present invention, a location of the at least one tilting portion corresponds to a location of the at least one recess for allowing the at least one tilting portion and the at least one recess to contact each other.

According to one embodiment of the present invention, an appearance of the at least one tilting portion is arc-shaped, and an appearance of the at least one recess is arc-shaped.

According to one embodiment of the present invention, the at least one tilting portion is a plurality of tilting portions; the at least one recess is a plurality of recesses; a quantity of the plurality of tilting portions is equal to a quantity of the plurality of recesses; and the location of each of the tilting portions corresponds to the location of each of the plurality of recesses.

According to one embodiment of the present invention, the quantity of the plurality of tilting portions and the quantity of the plurality of recesses are both three.

According to one embodiment of the present invention, a distance between each tilting portion is equal.

According to one embodiment of the present invention, the opening further comprises a guide groove.

According to one embodiment of the present invention, the guide groove is situated at one of the plurality of recesses.

According to one embodiment of the present invention, the guide groove is connected to the main body engaging element.

Therefore, due to the plurality of recesses around the outer edge wall of the upper-surface of the main body along with the corrugated wall of the outer boundary of the lid, the lid can be detached from the main body by the user placing one finger into the recess and pressing against the corrugated wall tilting portion, and then by lifting the lid up for releasing the engagement between the main body and the lid, such that the lid is detached afterwards. Therefore, no tools, such as a spoon or a screwdriver, are needed.

Furthermore, when the lid needs to be placed separately, the contents inside the main body will not contaminate the lid, because the design of the corrugated wall of the lid outer boundary keeps the area that the fingers touch clean.

DETAILED DESCRIPTION OF THE PREFERRED EMBODIMENTS

The exemplary embodiment(s) of the present invention will be understood more fully from the detailed description given below and from the accompanying drawings of various embodiments of the invention, which, however, should not be taken to limit the invention to the specific embodiments, but are for explanation and understanding only.

Please refer to FIG. 1 to FIG. 5. The container with an easily-detached lid comprises a main body 1 and a lid 2.

Figure 1:
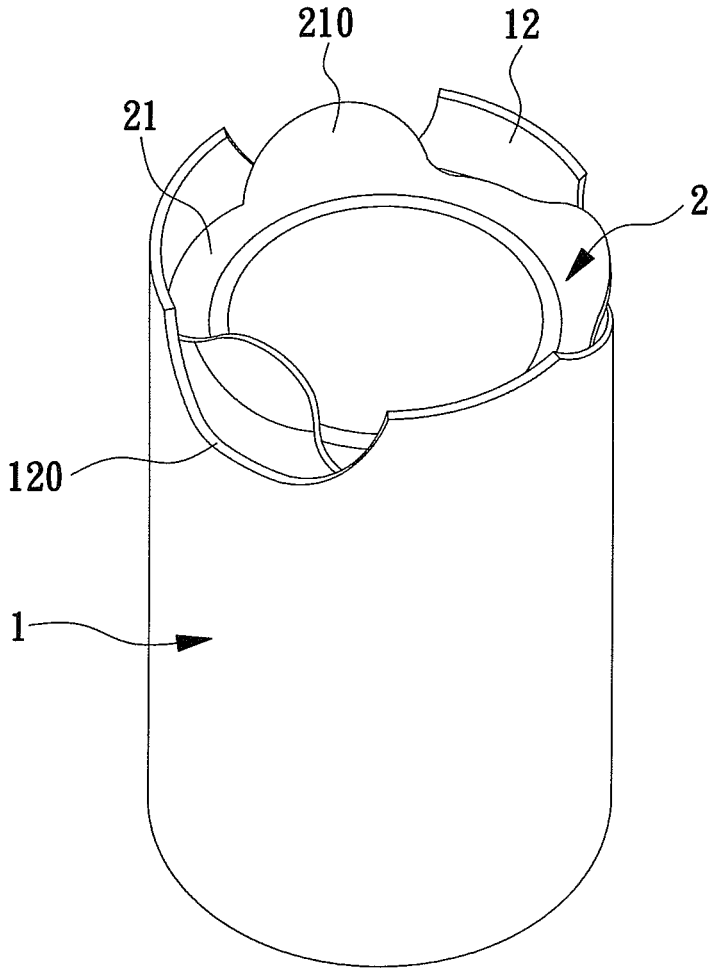
FIG. 1 is a perspective view of the present invention.
Figure 2:
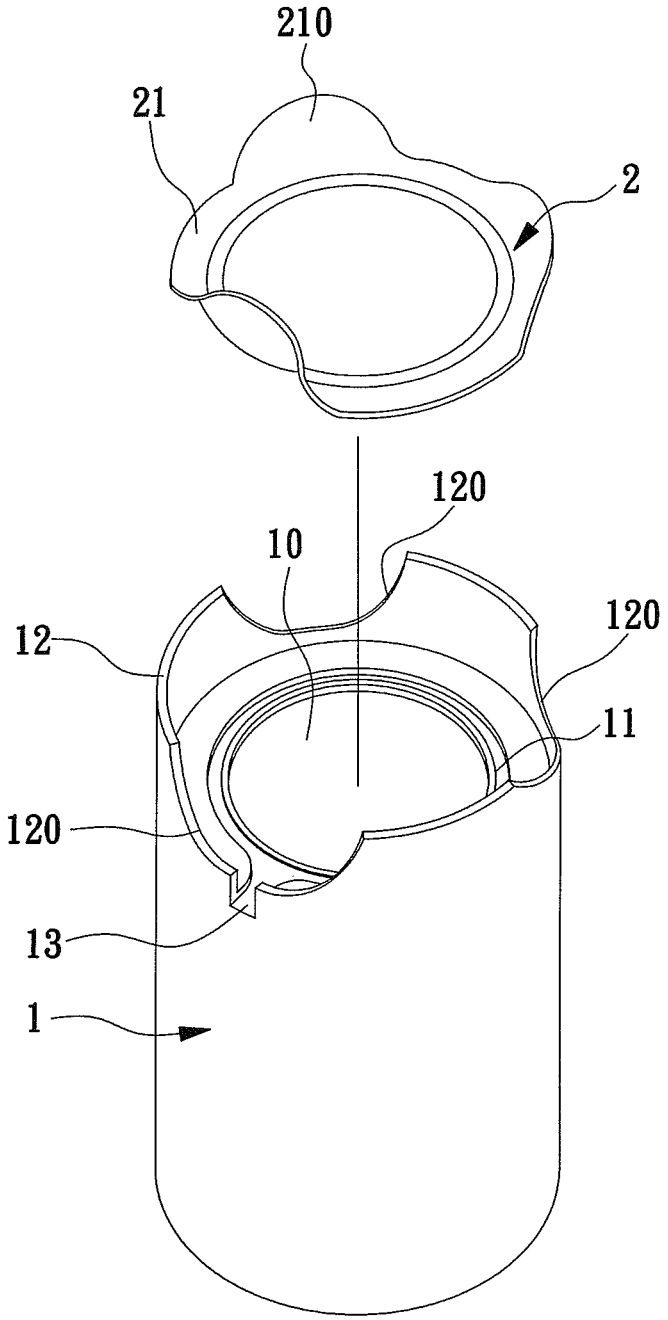
FIG. 2 is an exploded perspective view of the present invention.

As shown in FIG. 1 and FIG. 2, the main body 1 comprises an opening 10, a main body engaging element 11, an outer edge wall 12, and a guide groove 13. The main body engaging element 11 is disposed around the edge of the opening 10. The outer edge wall 12 has at least one recess 120. The guide groove 13 is situated at the at least one recess 120.

Figure 3:
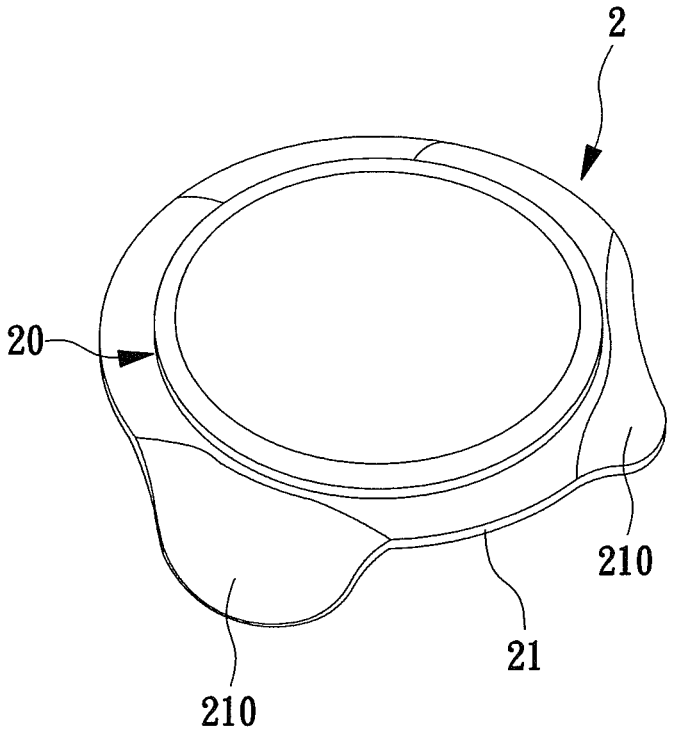
FIG. 3 is a bottom view of the lid.

As shown in FIG. 1 to FIG. 3, the lid 2 comprises a lid engaging element 20. The lid engaging element 20 corresponds to the main body engaging element 11 for allowing the lid 2 to engage with the main body 1 via the main body engaging element 11 and the lid engaging element 20. The improvement of the lid 2 is characterized in that a wall 21 is disposed at an outer boundary of the lid 2 and in that the wall 21 comprising at least one tilting portion 210.

In one embodiment of the present invention, a location of the at least one tilting portion 210 corresponds to a location of the at least one recess 120 to allow the at least one tilting portion 210 and the at least one recess 120 to contact each other. In addition, the at least one recess 120 and the at least one tilting portion 210 are both arc-shaped.

In another embodiment of the present invention, the quantities of the at least one recess 120 and the at least one tilting portion 210 are plural, and a quantity of the plurality of tilting portions 210 is equal to a quantity of the plurality of recesses 120. The location of each of the tilting portions 210 corresponds to the location of each of the recesses 12, and a distance in between each tilting portion 210 is equal. Furthermore, the guide groove 13, for allowing the content inside the main body 1 to flow out smoothly, is situated at one of the plurality of recesses 120 and is connected to the main body engaging element 11.

Please refer to FIG. 1 to FIG. 3. In this embodiment, a rounded opening 10 is situated at an upper-surface of the main body 1, and an engagement element 11 is disposed at the edge of the opening 10. An outer edge wall 12 is situated at the upper-surface, extending upwardly and comprising three recesses 120 to form a corrugated-shaped appearance of the outer edge wall 12.

As shown in FIG. 1 to FIG. 3, a lower-surface portion of the lid 2 has a lid engaging element 20 that can be engaged with the main body engaging element 11, and the wall 21 is disposed around the outer boundary of the lid engaging element 20. In this embodiment, the quantity of the tilting portions 210 is three, and the distance between each tilting portion 210 is equal.

As shown in FIG. 1 and FIG. 2, the location of each tilting portion 210 matches the corresponding recess 120 around the outer edge wall 12 of the main body 1 to allow an object whose width is substantially the same as a finger to be placed into an area where the recess 120 of the outer edge wall 12 contacts the tilting portion 210 of the wall 21.

Figure 4:
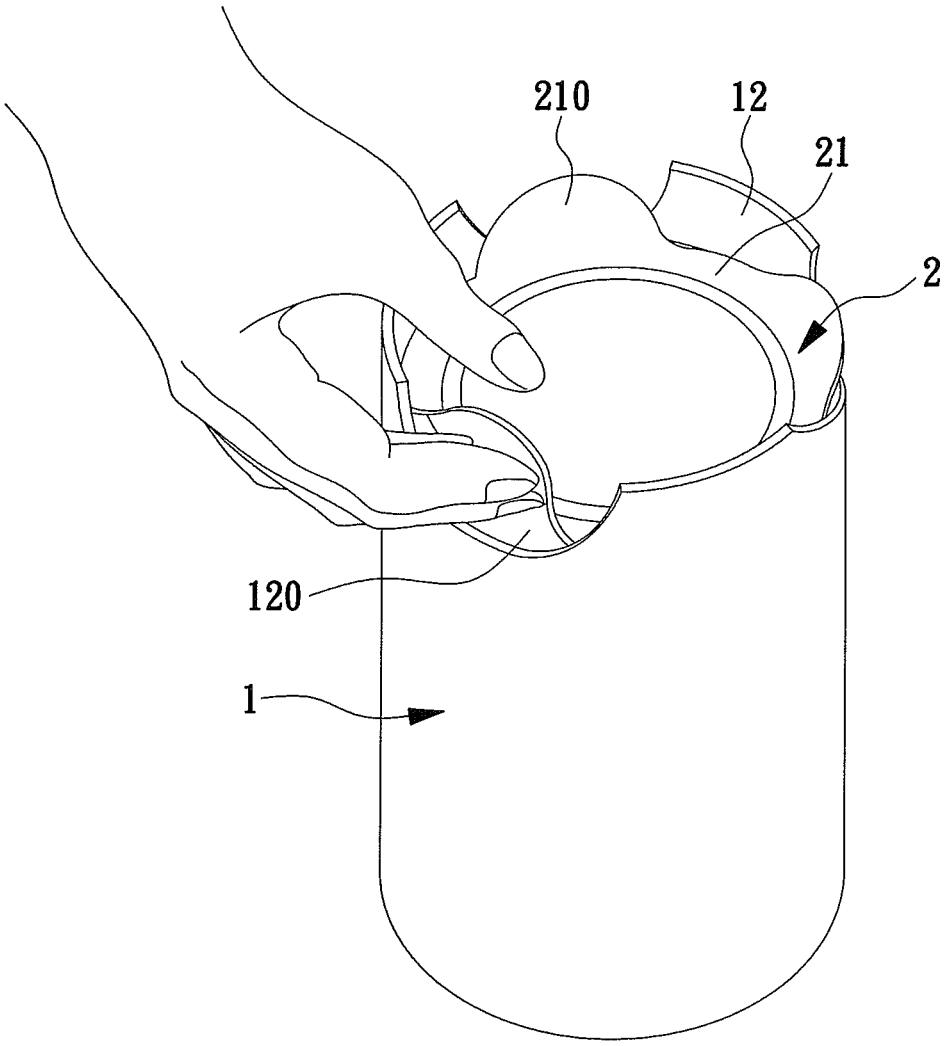
FIG. 4 is a schematic drawing of the present invention in a usage state.
Figure 5:
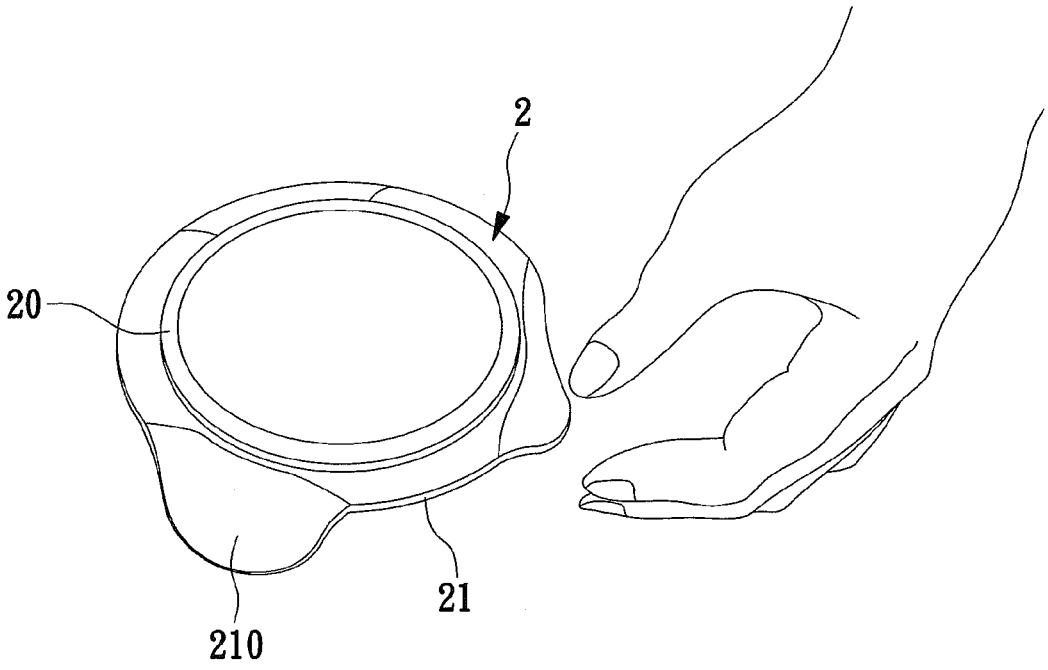
FIG. 5 is a schematic drawing of the lid in the usage state.

Please refer to FIG. 4 and FIG. 5. The advantages of the present invention are that the present invention facilitates the detachment of the lid 2 from the main body 1 and applies the plurality of recesses 120 situated at the outer edge wall 12 at the upper-surface of the main body 1 to ensure the cleanness of an area of the lid 2 where the finger touches.

As shown in FIG. 4, when the main body 1 engages with the lid 2, the tilting portion 210 situated at the wall 21 matches the recess 120 of the outer edge wall 12. An object such as a finger can be placed into an area where the tilting portion 210 of the wall 21 contacts the recess 120. Therefore, when a content inside the man body 1 is to be used, the lid 2 can be detached from the main body 1 by the user placing one finger into the recess 120 and pressing against the tilting portion 210 at the wall 21 and then lifting up the lid 2 to release the engagement between the main body engaging element 11 and the lid engaging element 20, such that the lid 2 is removed easily without any tools.

Please refer to FIG. 5. After the lid 2 is detached from the main body 1, the lid 2 can be placed separately. Due to the unique design of the outer boundary of the wall 21 of the lid 2, when the lid 2 needs to be lifted, the user can touch only the tilting portion 210 of the wall 21 and thereby can avoid touching the contents inside the main body 1, such as milk powder or paint. As a result, the cleanness of the area of the lid 2 where the finger touches can be assured to a high level of cleanness, because the contents inside the main body 1, such as milk powder or paint, cannot accumulate on the lower surface of the lid 2.

It must be noted that the above-mentioned embodiments are only for illustration purposes. It is intended that the present invention cover modifications and variations of this invention provided that they fall within the scope of the following claims and their equivalents. Therefore, it will be apparent to those skilled in the art that various modifications and variations can be made to the structure of the present invention without departing from the scope or spirit of the invention.

What is claimed is:

1. A container comprising:

a main body having an opening and a main body engaging element disposed around an edge of the opening, wherein the main body comprises an outer edge wall, with the outer edge wall having circular cross sections parallel to the edge of the opening and extending from the main body away from the opening, wherein the main body further comprises at least one recess extending downwardly from and intersecting an outer edge of the outer edge wall;

a lid having a lid engaging element corresponding to the main body engaging element, with the lid engaging with the main body via the main body engaging element and the lid engaging element; and a wall disposed at an outer boundary of the lid, wherein the wall comprises at least one tilting portion extending upwardly away from the opening, with the at least one tilting portion extending concentrically to and within the outer edge wall and located in and at least partially closing the at least one recess when the lid is engaged with and closes the opening of the main body.

2. The container as claimed in claim 1, wherein a location of the at least one tilting portion is corresponding to a location of the at least one recess for allowing the at least one tilting portion and the at least one recess to contact each other.

3. The container as claimed in claim 2, wherein the at least one tilting portion is solid and closed and is arc-shaped, and wherein an appearance of the at least one recess is arc-shaped.

4. The container as claimed in claim 3, wherein the at least one tilting portion is a plurality of tilting portions; wherein the at least one recess is a plurality of recesses; wherein a quantity of the plurality of tilting portions is equal to a quantity of the plurality of recesses; and wherein the location of each of the plurality of tilting portions corresponds to the location of each of the plurality of recesses.

5. The container as claimed in claim 4, wherein a quantity of the plurality of tilting portions and a quantity of the plurality of recesses are both three, wherein the plurality of tilting portions are circumferentially spaced and extend upwardly from the lid to support the lid when detached from the main body and inverted.

6. The container as claimed in claim 5, wherein a distance between each tilting portion is equal.

7. The container as claimed in claim 6, further comprising a guide groove extending entirely through the outer edge wall and extending from the main body away from the opening.

8. The container as claimed in claim 7, wherein the guide groove is situated at one of the plurality of recesses.

9. The container as claimed in claim 8, wherein the guide groove is connected to the main body engaging element.

10. The container as claimed in claim 1, further comprising a guide groove extending entirely through the outer edge wall and extending from the main body away from the opening.

11. The container as claimed in claim 10, wherein the guide groove is situated at the at least one recess.

12. The container as claimed in claim 11, wherein the guide groove is connected to the main body engaging element.

13. The container as claimed in claim 12, wherein the at least one tilting portion is a plurality of tilting portions; wherein the at least one recess is a plurality of recesses; wherein a quantity of the plurality of tilting portions is equal to a quantity of the plurality of recesses; and wherein a location of each of the plurality of tilting portions corresponds to a location of each of plurality of the recesses.

14. The container as claimed in claim 13, wherein a quantity of the plurality of tilting portions and a quantity of the plurality of recesses are both three, wherein the plurality of tilting portions are circumferentially spaced and extend upwardly from the lid to support the lid when detached from the main body and inverted.

15. The container as claimed in claim 14, wherein each tilting portion is solid and closed and is arc-shaped, and wherein each recess appearance is arc-shaped.

16. The container as claimed in claim 1, wherein the at least one tilting portion is a plurality of tilting portions; wherein the at least one recess is a plurality of recesses; wherein a quantity of the plurality of tilting portions is equal to a quantity of the plurality of recesses; and wherein a location of each tilting portion corresponds to a location of each recess.

17. The container as claimed in claim 16, wherein the quantity of the plurality of tilting portions and the quantity of the plurality of recesses are both three, wherein the plurality of tilting portions are circumferentially spaced and extend upwardly from the lid to support the lid when detached from the main body and inverted.

18. The container as claimed in claim 17, wherein a distance between each tilting portion is equal.

19. The container as claimed in claim 18, further comprising a guide groove extending entirely through the outer edge wall and extending from the main body away from the opening; wherein the guide groove is situated at one of the plurality of recesses and is connected to the main body engaging element.

* * * * *